US006433488B1

(12) United States Patent
Bu

(10) Patent No.: US 6,433,488 B1
(45) Date of Patent: Aug. 13, 2002

(54) OLED ACTIVE DRIVING SYSTEM WITH CURRENT FEEDBACK

(75) Inventor: Lin-kai Bu, Tainan (TW)

(73) Assignee: Chi Mei Optoelectronics Corp., Tainan (TW)

( * ) Notice: Subject to any disclaimer, the term of this patent is extended or adjusted under 35 U.S.C. 154(b) by 0 days.

(21) Appl. No.: 09/823,180

(22) Filed: Mar. 29, 2001

(30) Foreign Application Priority Data

Jan. 2, 2001 (TW) ..... 090100073 A

(51) Int. Cl.[7] ..... G09G 3/10

(52) U.S. Cl. ..... 315/169.3; 315/169.1; 315/302; 345/82; 345/84; 345/212

(58) Field of Search ..... 315/169.3, 169.1, 315/169.2, 300, 302, 273, 275, 169.4; 345/39, 46, 63, 82, 84, 204, 212, 213

(56) References Cited

U.S. PATENT DOCUMENTS 5,684,368 A 11/1997 Wei et al. ..... 315/302
5,723,950 A 3/1998 Wei et al. ..... 315/169.3
5,748,160 A 5/1998 Shieh et al. ..... 345/82
5,818,068 A * 10/1998 Sasaki et al. ..... 257/59
5,952,789 A * 9/1999 Stewart et al. ..... 315/169.1
6,011,529 A * 1/2000 Ikeda ..... 345/76
6,023,259 A 2/2000 Howard et al. ..... 345/76
6,278,242 B1 * 8/2001 Cok et al. ..... 315/169.1

* cited by examiner

*Primary Examiner*—Haissa Philogene
(74) *Attorney, Agent, or Firm*—Martine & Penilla, LLP

(57) ABSTRACT

The invention provides an organic light emitting diode active driving system with current feedback, thereby a driving current for organic light emitting diode is not affected by variation of characteristic parameters of thin film transistor under an active driving mode. The active driving system in accordance with the invention includes a transistor and a current comparator for driving an organic light emitting diode. The transistor has two current carrying electrodes respectively connected to a cathode of the organic light emitting diode and ground, and a gate controlled by a data signal. The current comparator has two input terminals respectively receive a reference current with predetermined value and a driving current flowing through the organic light emitting diode. The current comparator compares the reference current and the driving current, and then outputs a voltage to the gate of the transistor in response to the comparison result so as to make the value of the driving current equal to that of the reference current. Therefore, the active driving system for organic light emitting diode array or flat panel display in accordance with the invention can achieve a desirable light emission uniformity.

8 Claims, 3 Drawing Sheets

OLED ACTIVE DRIVING SYSTEM WITH CURRENT FEEDBACK

BACKGROUND OF THE INVENTION

1. Field of the Invention

The invention relates to an active driving circuit system for organic light emitting diode (OLED) and, more particularly, to an OLED active driving system for improving light emission uniformity of an array or flat panel display (FPD) made up of OLEDs by current feedback.

2. Description of the Related Art

Recently, since OLED arrays can generate relatively high luminance of light and have relatively low production and operation costs, they are becoming more and more popular as FPDs. Besides, OLEDs can be fabricated in a variety of sizes from very small (less than a tenth millimeter in diameter) to relatively large (greater than an inch) so that OLED arrays can be fabricated in a variety of sizes. Also, OLED arrays can generate most colors of light with relative ease and provide a very wide viewing angle.

All OLEDs work on the same general principles described as follows. Firstly, one or more layers of organic material are sandwiched between two electrodes. A current is then applied to the OLEDs, causing negatively charged electrons to move into the organic material from the cathode. Positive charges typically referred to as holes move in from the anode. Then, the positive and negative charges meet, combine, and produce photons in the center layers (i.e., the organic material). The color of the photons depends on the electronic properties of the organic material in which the photons are generated.

As disclosed in U.S. Pat. No. 5,748,160, two-dimensional OLED arrays typically contain rows and columns of OLEDs. FIG. 1 shows one of the OLEDs, which is designated by reference numeral 1. Referring to FIG. 1, the OLED 1 is connected to a circuit block 2. The circuit block 2 includes a first transistor 21 having a current carrying electrode 211 connected to a cathode of the OLED 1 and a current carrying electrode 212 connected to ground. The circuit block 2 further includes a second transistor 22 having a current carrying electrode 221 connected to a gate electrode 213 of the first transistor 21. Another current carrying electrode 222 of the second transistor 22 serves as a data signal input terminal 4, and a gate electrode 223 of the second transistor 22 serves as a scan signal input terminal 3. Besides, a capacitor 23 is connected between the gate electrode 213 and ground as a storage element so as to maintain the OLED 1 in an ON mode for a specific period of time, and control the flowing of some fixed current, wherein the current value is determined by the gate-source voltage Vgs of the first transistor 21.

The OLED 1 is addressed by supplying a scan signal to the gate electrode 223 of the second transistor 22, and supplying a data signal to the current carrying electrode 222. Specifically, the scan signal activates the second transistor 22 so that the data signal is input to the gate electrode 213 of the first transistor 21 through the current carrying electrodes 222 and 221. Thereby, the gate electrode 213 is activated. At this time, a current path is completed between the cathode of OLED 1 and ground. Since a supply voltage Vs is connected to the anode of OLED 1, the current flows through the OLED 1, which thus emits light.

OLEDs are typically current driven devices (i.e., emit due to current flowing through them), as opposed to voltage driven devices such as liquid crystal displays (LCDs).

Therefore, in an array or FPD made up of OLEDs, it must be assured that each of the OLEDs is driven by the same current under the same supply voltage in order to achieve superior light emission uniformity. However, since the first transistors 21 of the OLEDs do not have the same characteristic parameters, different driving currents can be generated under the same supply voltage. Therefore, the conventional array or FPD made up of OLEDs cannot achieve desirable light emission uniformity.

SUMMARY OF THE INVENTION

In view of the above-mentioned requirement for light emission uniformity of OLED array or FPD, the invention provides an OLED active driving system with current feedback. With the OLED active driving system, a driving current for OLED is not affected by variation of characteristic parameters of thin film transistor under an active driving mode, so that the OLED array or FPD can achieve desirable light emission uniformity.

In one embodiment in accordance with the invention, a cathode of an OLED is connected to a current carrying electrode of a first transistor. A current carrying electrode of a second transistor is connected to a gate electrode of the first transistor. Another current carrying electrode of the second transistor serves as a data signal input terminal, and the gate electrode serves as a scan signal input terminal. A capacitor is connected between a gate electrode of the first transistor and ground as a storage element. Two current carrying electrodes of a third transistor are respectively connected to an anode of the OLED and a comparison terminal of a current comparator. A gate electrode of the third transistor is connected to the scan signal input terminal. Two current carrying electrodes of a fourth transistor are respectively connected to the anode of the OLED and a supply voltage. The gate electrode of the fourth transistor serves to receive a reverse signal of the scan signal.

In order to make the driving current input from the third transistor into the OLED not affected by variation of characteristic parameters of a thin film transistor under active driving mode, another comparison terminal of the current comparator is connected to a reference current source for receiving a reference current with predetermined value. The current comparator compares the driving current and the reference current, and then outputs a voltage to the gate electrode of first transistor in response to the comparison result. The gate electrode of the first transistor controls the value of driving current, and therefore the driving current is maintained at the value of reference current due to the feedback effect of the voltage.

DDESCRIPTION OF THE PREFERRED EMBODIMENT

The above-mentioned objects, features, and advantages of the invention will be more apparent from the following description, referring to the accompanying drawings. Preferred embodiments in accordance with the invention will be described in detail with reference to accompanying drawings.

Figure 1:
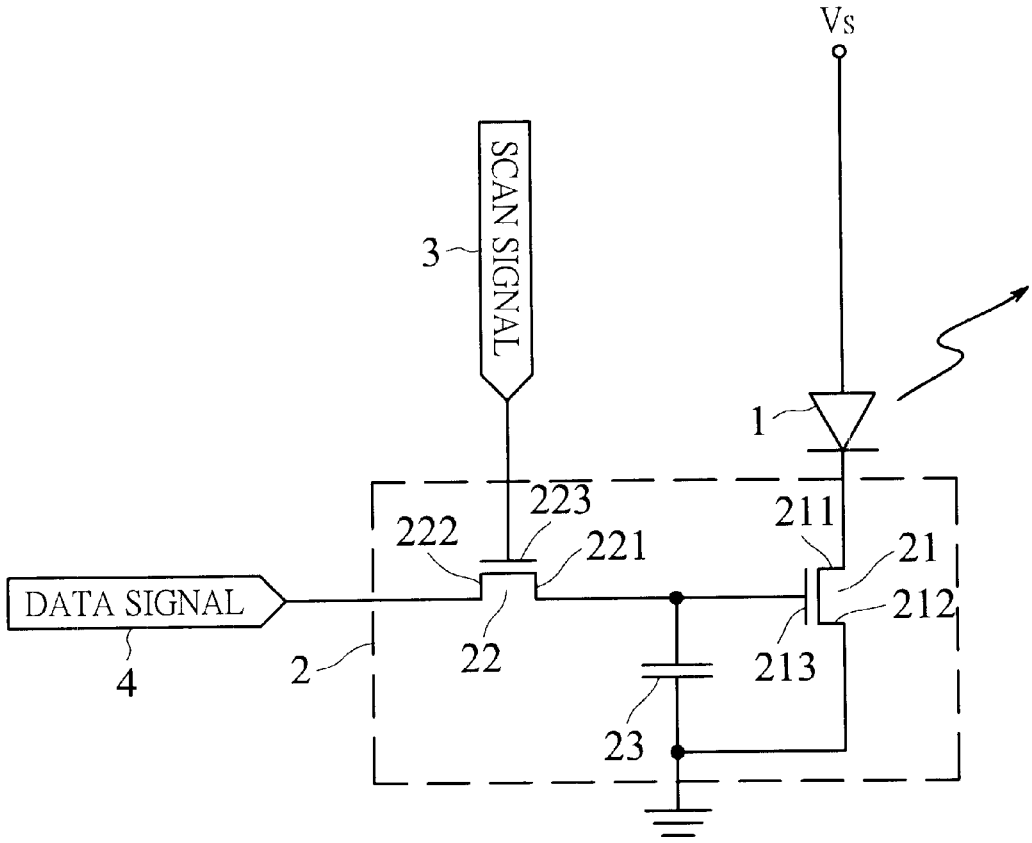
Fig. 1 (PRIOR ART)
FIG. 1 is a circuit diagram showing one unit of a conventional organic light emitting diode array.
Figure 2:
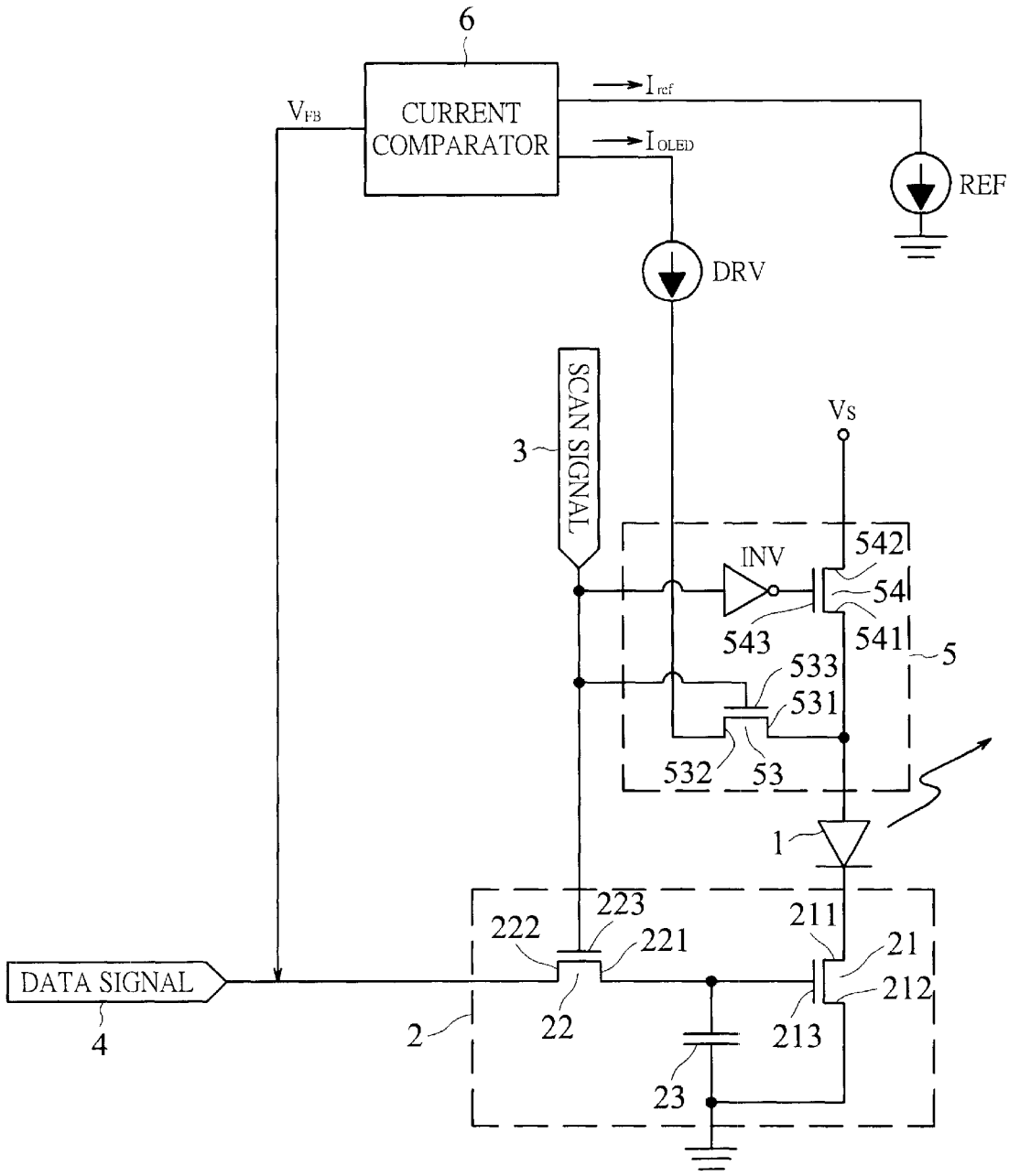
FIG. 2 is a circuit diagram showing one unit of a organic light emitting diode array, with the use of an active driving system with current feedback, in accordance with the invention.

Referring to FIG. 2, one unit of an OLED array or FPD in accordance with the invention includes an OLED 1, a first circuit block 2, a second circuit block 5, and a current comparator 6. In FIG. 2, similar elements as in FIG. 1 are designated by similar reference numerals. For the sake of simplification, only the difference of the invention from the prior art will be described hereinafter.

The second circuit block 5 includes a third transistor 53, which has a current carrying electrode 531 connected to an anode of the OLED 1 and a current carrying electrode 532 connected to a comparison terminal of the current comparator 6. The third transistor 53 has a gate electrode 533 connected to a scan signal input terminal 3. The second circuit block 5 further includes a fourth transistor 54, which has a current carrying electrode 541 connected to an anode of the OLED 1 and a current carrying electrode 542 connected to supply voltage Vs. In the present invention, the supply voltage Vs is the supply voltage of the LCD panel. The fourth transistor 54 has a gate electrode 543 for receiving a reverse signal of the scan signal through another scan line.

The current comparator 6 has two comparison terminals, which respectively receive a driving current $I_{OLED}$ and a reference current $I_{ref}$ supplied from a reference current source REF. The current comparator 6 has an output terminal, which outputs a feedback voltage $V_{FB}$ to a data signal input terminal 4 in response to the obtained result of comparing of the driving current $I_{OLED}$ and reference current $I_{ref}$. The operation of the organic light emitting diode active driving system with current feedback in accordance with the invention will be described in detail.

First, as with the prior art, the scan signal and the data signal are input to the first circuit block 2 through the scan signal input terminal 3 and the data signal input terminal 4 respectively, in order to activate the second transistor 22 and the first transistor 21. At this time, the scan signal and its reverse signal are respectively input to the gate electrode 533 of the third transistor 53 and the gate electrode 543 of the fourth transistor 54. Therefore, the third transistor 53 is in an ON mode and the fourth transistor 54 is in an OFF mode so that a comparison terminal of the current comparator 6 can receive the driving current $I_{OLED}$ that flows through the OLED 1.

As described above, since the OLED is a current-driven element, it is required that the driving currents $I_{OLED}$ flowing through respective OLEDs are the same under the same display gray level in order to assure the light emission uniformity of the OLED array or FPD made up of OLEDs. To achieve the object, another comparison terminal of the current comparator 6 is connected to the reference current source REF for receiving a reference current $I_{ref}$ with predetermined value. The current comparator 6 compares the driving current $I_{OLED}$ and the reference current $I_{ref}$, and then output a feedback voltage $V_{FB}$ to the gate electrode 213 of the first transistor 21 in response to the comparison result. The voltage of the gate electrode 213 controls the value of the driving current $I_{OLED}$, and therefore the driving current $I_{OLED}$ is maintained at the value of reference current $I_{ref}$ due to the feedback effect of the feedback voltage $V_{FB}$.

Specifically, in the case that the first to fourth transistors 21, 22, 53, 54 are all n-channel transistors, the current comparator 6 is designed that when the value of the driving current $I_{OLED}$ is smaller than that of the reference current $I_{ref}$, a plus feedback voltage $V_{FB}$ is output so that the voltage of the gate electrode 213 increases, which then increases the driving current $I_{OLED}$ On the contrary, when the value of the driving current $I_{OLED}$ is larger than that of the reference current $I_{ref}$, a minus feedback voltage $V_{FB}$ is output so that the voltage of the gate electrode 213 decreases, which then decreases the driving current $I_{OLED}$ Therefore, the current comparator 6 in accordance with the invention assures that the value of the driving current $I_{OLED}$ is equal to that of the reference current $I_{ref}$, which is not affected by different characteristic parameters of the first transistor 21.

When the aforementioned programming mode is finished, the scan signal is turned into low level so that the third transistor 53 is in an OFF mode and the fourth transistor 54 is in an ON mode. Therefore, the driving current $I_{OLED}$ is input from the supply voltage Vs to the OLED 1. The gate voltage of the first transistor 21 maintained by the capacitor 23 is adjusted so that the driving current $I_{OLED}$ is not affected by the characteristic parameters of the first transistor 21. Therefore, each OLED 1 driven by the same voltage has the same driving current $I_{OLED}$ flowing through it. Therefore, the organic light emitting diode active driving system with current feedback in accordance with the invention can achieve the object of making a uniform light emission of the array or FPD made up of OLEDs.

Figure 3:
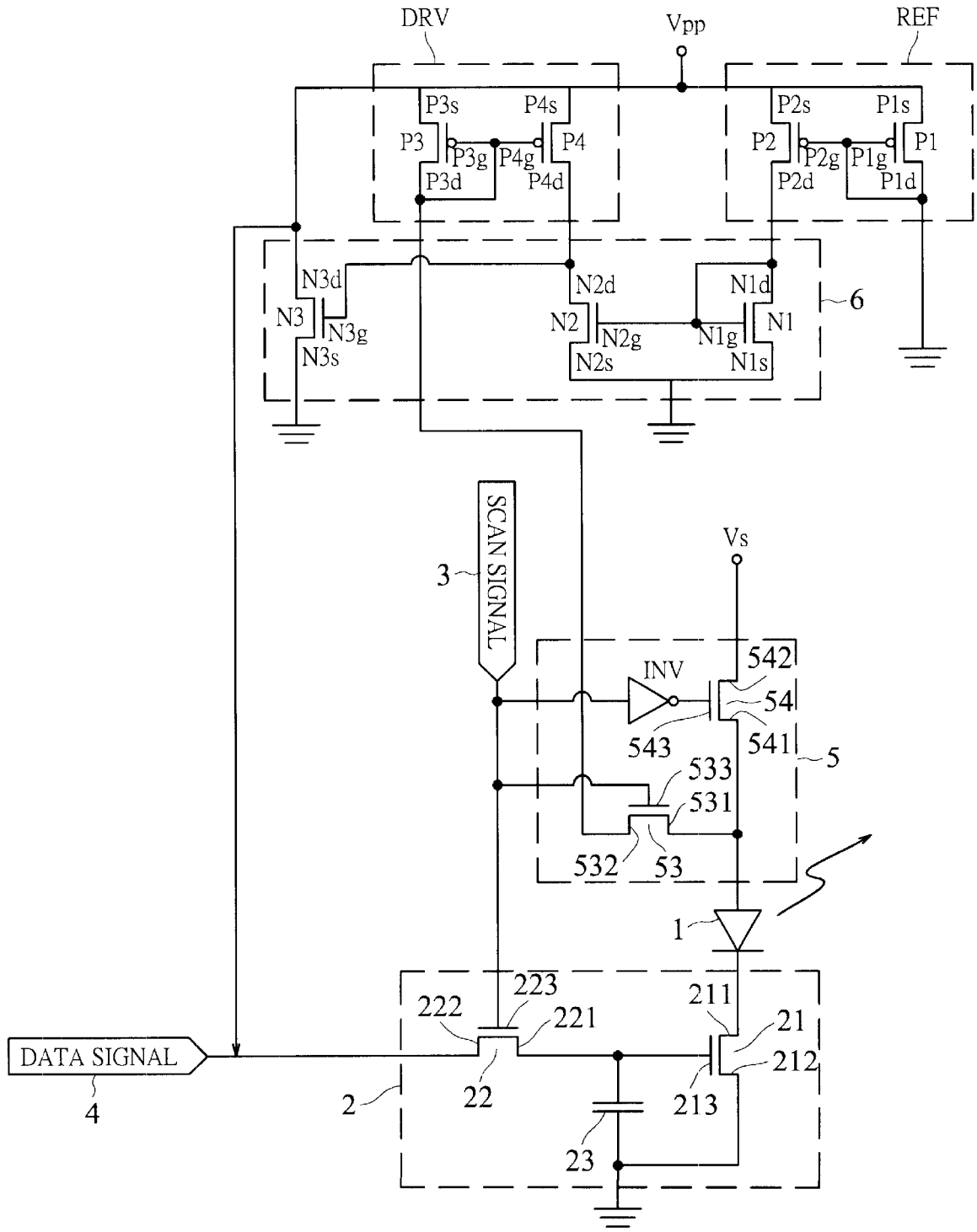
FIG. 3 is a circuit diagram showing one example of a current comparator in accordance with the invention.

FIG. 3 shows an example of the current comparator 6 in accordance with the invention. Referring to FIG. 3, the current comparator 6 is made up of four p-type transistors P1, P2, P3, and P4, and three n-type transistors N1, N2, and N3. Specifically, two p-type transistors P1 and P2 with the same threshold voltage constitute a current mirror, wherein sources P1*s* and P2*s* of the transistors P1 and P2 are connected to a supply voltage Vpp, and gates P1*g* and P2*g* of the transistors P1 and P2 are connected to each other. Also, the gate P1*g* and drain P1*d* of the transistor P1 are connected to each other. The drain P1*d* of the transistor P1 serves as a comparison terminal of the current comparator 6, and is connected to a reference current source REF that supplies reference current $I_{ref}$. Due to the current mirror, a current proportional to the reference current $I_{ref}$ is output from the drain P2*d* of the transistor P2. It is preferable that the proportional constant is 1.

Two p-type transistors P3 and P4 with the same threshold voltage constitute a current mirror of driving current, wherein the sources P3*s* and P4*s* of the transistors P3 and P4 are connected to the supply voltage Vpp, and gates P3*g* and P4*g* of the transistors P3 and P4 are connected to each other. Also, the gate P3*g* and drain P3*d* of the transistor P3 are connected to each other. The drain P3*d* of the transistor P3 serves as another comparison terminal of the current comparator 6, and is connected to the above-mentioned current carrying electrode 532 of the third transistor 53 through which flows the driving current $I_{OLED}$ Due to the current mirror, a current proportional to the driving current $I_{OLED}$ is output from the drain P4*d* of the transistor P4. It is preferable that the proportional constant is 1.

The transistors N1 and N2 have the same threshold voltage for providing a compare function for the current comparator 6. To go into details, the drain N1*d* of the transistor N1 receives a current corresponding to the reference current $I_{ref}$, and the drain N2*d* of the transistor N2 receives a current corresponding to the driving current $I_{OLED}$ Besides, the gates N1*g* and N2*g* of the transistors N1 and N2 are connected to each other and the sources N1*s* and N2*s* thereof are connected to ground. Also, the gate N1*g* and drain N1*d* of the transistor N1 are connected to each other. The transistor N3, as an output of the current comparator 6, has its gate electrode N3*g* connected to the drain N2*d* of the transistor N2, its drain electrode N3*d* connected to the supply voltage Vpp, and its source electrode N3*s* connected to ground.

The transistors N1 and N2 are arranged into a current mirror structure, and therefore there is a proportional relationship between the reference current $I_{ref}$ and the driving current $I_{OLED}$ under a stable condition. It is preferable that the proportional constant is 1. In this case, when the value of the driving current $I_{OLED}$ is smaller than that of the reference current $I_{ref}$, a drain voltage $V_{N2d}$ of the transistor N2 decreases so that a drain voltage $V_{N3d}$ output by the transistor N3 increases. Since the increase of the drain voltage $V_{N3d}$ makes the gate voltage of the first transistor 21 in the first circuit block 2 to increase, the driving current $I_{OLED}$ increases. On the contrary, when the value of the driving current $I_{OLED}$ is larger than that of the reference current $I_{ref}$, the drain voltage $V_{N2d}$ of the transistor N2 increases so that the drain voltage $V_{N3d}$ output by the transistor N3 decreases. Since the decrease of the drain voltage $V_{N3d}$ makes the gate voltage of the first transistor 21 in the first circuit block 2 to decrease, the driving current $I_{OLED}$ decreases. Therefore, the organic light emitting diode active driving system with current feedback in accordance with the invention assures that the value of the driving current $I_{OLED}$ equals to that of the reference current $I_{ref}$. Thereby, the OLED array or FPD made up of OLEDs can achieve uniform light emission.

While the present invention has been particularly described, in conjunction with specific examples, it is evident that many alternatives, modifications and variations will be apparent to those skilled in the art in light of the foregoing description. It is therefore contemplated that the appended claims will embrace any such alternatives, modifications and variations as decreaseing within the true scope and spirit of the present invention.

What is claimed is:

1. An organic light emitting diode active driving system with current feedback for driving an organic light emitting diode, comprising:

a first transistor having a current carrying electrode connected to a cathode of said organic light emitting diode, a current carrying electrode connected to ground, and a gate electrode;

a second transistor having a current carrying electrode connected to a gate electrode of said first transistor, a current carrying electrode as a data signal input terminal, and a gate electrode as a scan signal input terminal;

a capacitor connected between said gate electrode of said first transistor and ground as a storage element;

a current comparator having two comparison terminals and an output terminal connected to said data signal input terminal;

a third transistor having a current carrying electrode connected to an anode of said organic light emitting diode, a current carrying electrode connected to a comparison terminal of said current comparator, and a gate electrode connected to said scan signal input terminal; and a fourth transistor having a current carrying electrode connected to an anode of said organic light emitting diode, a current carrying electrode connected to a first supply voltage, and a gate electrode for receiving a reverse signal of said scan signal input terminal;

wherein said two comparison terminals of said current comparator respectively receive a reference current with a predetermined value and a driving current flowing through said organic light emitting diode, compare said reference current and said driving current, and output a voltage to said data input terminal in response to a comparison result, so that the value of said driving current equals to that of said reference current.

2. The organic light emitting diode active driving system with current feedback as in claim 1, wherein said current comparator comprises:

a fifth transistor having a drain for receiving said reference current, a source connected to ground, and a gate connected to said drain of said fifth transistor;

a sixth transistor having a drain for receiving said driving current, a source connected to ground, and a gate connected to said gate of said fifth transistor; and a seventh transistor having a drain connected to said data input terminal, a source connected to ground, and a gate connected to said drain of said sixth transistor.

3. The organic light emitting diode active driving system with current feedback as in claim 2, wherein said fifth, sixth, and seventh transistors are n-channel transistors, and a threshold voltage of said fifth transistor equals to that of said sixth transistor.

4. The organic light emitting diode active driving system with current feedback as in claim 2, wherein said current comparator further comprises:

an eighth transistor having a drain connected to a reference current source and as a comparison terminal of said current comparator, a source connected to a second supply voltage, and a gate connected to said drain of said eighth transistor;

a ninth transistor having a drain connected to said drain of said fifth transistor, a source connected to said second supply voltage, and a gate connected to said gate of said eighth transistor.

5. The organic light emitting diode active driving system with current feedback as in claim 4, wherein said eighth and ninth transistors are p-channel transistors, which constitute a current mirror structure, and a threshold voltage of said eighth transistor equals to that of said ninth transistor.

6. The organic light emitting diode active driving system with current feedback as in claim 2, wherein said current comparator further comprises:

a tenth transistor having a drain connected to said current carrying electrode of said third transistor as another comparison terminal of said current comparator, a source connected to said second supply voltage, and a gate connected to said drain of said tenth transistor;

a eleventh transistor having a drain connected to said drain of said sixth transistor, a source connected to said second supply voltage, and a gate connected to said gate of said tenth transistor.

7. The organic light emitting diode active driving system with current feedback as in claim 6, wherein said tenth and eleventh transistors are p-channel transistors, which constitute a current mirror structure, and a threshold voltage of said tenth transistor equals to that of said eleventh transistor.

8. The organic light emitting diode active driving system with current feedback as in claim 1, wherein said first, second, third, and fourth transistors are n-channel transistors.

* * * * *